United States Patent [19]

Nishikawa et al.

[11] Patent Number: 4,807,581

[45] Date of Patent: Feb. 28, 1989

[54] SYSTEM FOR CONTROLLING THE OPERATION OF AN INTERNAL COMBUSTION ENGINE

[75] Inventors: Toshihide Nishikawa; Kenichirou Hanada, both of Hiroshima; Yukinobu Nishimura; Setsuhiro Shimomura, both of Himeji, all of Japan

[73] Assignees: Mazda Motor Corporation; Mitsubishi Denki Kabushiki Kaisha, both of Japan

[21] Appl. No.: 930,103

[22] Filed: Nov. 13, 1986

[30] Foreign Application Priority Data

Nov. 13, 1985 [JP] Japan ..... 60-254071

[51] Int. Cl.[4] ..... F02D 41/18

[52] U.S. Cl. ..... 123/488; 123/480; 123/492; 73/118.2

[58] Field of Search ..... 123/478, 480, 488, 492, 123/494; 73/118.2; 364/431.03, 431.04, 431.05

[56] References Cited

U.S. PATENT DOCUMENTS

| | | | |
|---|---|---|---|
| 4,112,879 | 9/1978 | Assenheimer et al. | 123/478 |
| 4,450,816 | 5/1984 | Takimoto et al. | 123/492 |
| 4,523,570 | 6/1985 | Suzuki et al. | 123/478 |

FOREIGN PATENT DOCUMENTS

| | | | |
|---|---|---|---|
| 58-160518 | 9/1983 | Japan | 123/478 |
| 2031186 | 4/1980 | United Kingdom | 123/478 |

*Primary Examiner*—Andrew M. Dolinar

*Attorney, Agent, or Firm*—Leydig, Voit & Mayer

[57] ABSTRACT

A system for controlling the operation of an internal combustion engine on the basis of air/fuel ratios and engine loads. A flow rate of intake air sucked into the engine and the cycle of engine revolutions are detected to determine an average flow rate of intake air, which is then used in cooperation with a compression ratio and an engine displacement to determine a net flow rate of intake air or the charging efficiency of the engine. This parameter represents a precise engine load and is used to regulate fuel injected into the engine. As a result, engine operations may be optimally controlled even during transitional operating states of the engine.

10 Claims, 11 Drawing Sheets

TDC INTERRUPTION ROUTINE

TDC INTERRUPTION ROUTINE

TDC INTERRUPTION ROUTINE

SYSTEM FOR CONTROLLING THE OPERATION OF AN INTERNAL COMBUSTION ENGINE

BACKGROUND OF THE INVENTION

1. Field of the Invention

The present invention relates to a system for optimally controlling the operation of an internal combustion engine by adjusting the net flow rate of intake air sucked into the engine or the charging efficiency of the intake air in an appropriate manner.

2. Description of the Prior Art

FIG. 9 shows a general arrangement of a fuel injection system for an internal combustion engine employing an air-flow sensor (hereinafter referred to as an AFS) adapted to detect the flow rate of intake air sucked into the engine. In FIG. 9, the fuel injection system illustrated comprises an air cleaner 1, a hot-wire type AFS 2, a throttle valve 3 adapted to control the flow rate of intake air sucked into the engine, a surge tank 4, an intake manifold 5, an intake valve 6 adapted to be operated by an engine crank shaft (not shown) through the intermediary of a valve operating mechanism (not shown), a plurality of engine cylinders 7 only one of which is actually illustrated for simplification, a fuel injector 8 provided for each of the engine cylinders 7, and an electronic control unit 9 (hereinafter referred to as an ECU) for controlling the amount of fuel injected from each fuel injector 8 in relation to the flow rate of intake air sucked into the corresponding engine cylinder 7 in such a manner as to provide a predetermined air/fuel ratio. The ECU 9 functions to determine the amount of fuel injected by the respective fuel injectors 8 on the basis of control signals from the AFS 2, a crank-angle sensor 10 for detecting the rotation angle of the engine crank shaft (not shown), a starter switch 11, and a temperature sensor 12 adapted to detect the temperature of engine coolant. Also, the ECU 9 operates to control the pulse width of an electric pulse signal for each of the fuel injectors 8 in synchronization with a signal from the crank-angle sensor 10. In this connection, the crank-angle sensor 10 may be of any known type of sensor which acts to generate rectangular-shaped wave signals which fall at top dead center (hereinafter referred to as TDC) and rise at bottom dead center (hereinafter referred to as BDC) as the engine rotates.

FIG. 10 is a block diagram for explaining, in further detail, the operation of the ECU 9. In this Figure, the ECU 9 includes a revolution-number detecting section **9*a* for determining the number of revolutions of an engine by measuring a cycle of rectangular-shaped wave signals between adjacent TDCs; an average air-amount detecting section 9*b* for averaging the output signals from the AFS 2 between adjacent TDCs of the respective rectangular-shaped wave signals fed from the crank-angle sensor 10; a basic pulse-width arithmetic operation section 9*c* for determining a basic pulse width by dividing an average air flow output from the average air-amount detecting section 9*b* by a revolution-number output from the revolution-number detecting section 9*a*; a warming-up revising section 9*d* adapted to determine a revision coefficient corresponding to the temperature of an engine coolant detected by the temperature sensor 12 for revising the basic pulse width obtained by the basic pulse-width arithmetic operation section 9*c* by adding or multiplying thereto the revision coefficient so as to provide an optimal injection pulse width; a starting pulse-width arithmetic operation section 9*f* for determining an appropriate starting pulse width dependent upon the detected temperature of engine coolant; a switch 9*g* adapted to select the injection pulse width or the starting pulse width in response to an output signal from the starter switch 11 which acts to detect the starting point in time of the engine; and a timer 9*h* adapted to permit the injection pulse width or the starting pulse width as selected to operate in a one-shot motion at falling points (TDCs) of the output signal of the crank-angle sensor 10 whereby the fuel injectors 8 are driven to operate by means of an injector drive circuit 9*i***.

As is well known, the basic amount of fuel injected by each of the fuel injectors 8 is in proportion to the flow rate of air sucked into each engine cylinder 7 per revolution of the engine (or charging efficiency of intake air), and a process for determining arithmetic operation for the basic amount of fuel injected by each fuel injector 8 will be described below in detail with reference to FIG. 11.

As illustrated in FIG. 11(*a*), a crank-angle signal from the crank-angle sensor 10 has falling points corresponding to TDCs and rising points corresponding to BDCs with intervals between adjacent TDCs being at a crank angle of 180°. FIG. 11(*b*) shows a change in the flow rate of intake air during acceleration of the engine in which a solid line curve A corresponds to the output signal of the AFS 2 and a two-dot long and two short dashes line curve B corresponds to the output signal of the average air-amount detecting section **9*b* which represents an average of the AFS signal A between adjacent TDCs, and on the basis of which an appropriate amount of fuel to be injected by each fuel injector 8 is calculated. A broken line curve C represents a vacuum signal indicative of a vacuum in the intake manifold 5 which is approximate to the net flow rate of air actually sucked into the respective engine cylinders 7**.

From FIG. 11, it will be seen that during transitional operating periods of the engine such as when accelerating, the flow rate of air (curve A) measured by the AFS 2 becomes far greater than the net flow rate of air (curve C) actually sucked into the respective engine cylinders 7. This is because the flow rate of air measured by the AFS 2 involves, in addition to the flow rate of air supplied to the respective engine cylinders 7, the flow rate of air charged into those portions of the intake passage downstream of the throttle valve 3 which include the surge tank 4 and the intake manifold 5. Such a difference becomes particularly remarkable in the case of an intake arrangement layout in which the volume of the engine cylinders 7 is large in comparison with the volume of the surge tank 4.

FIGS. 11(*c*) through 11(*f*) show injection pulses when fuel is simultaneously injected into the respective engine cylinders 7 by the respective fuel injectors 8 in a four-cylinder internal combustion engine, in which the solid lines represent pulses based on the net flow rate of air actually sucked into the respective engine cylinders 7, and the broken lines represent pulses based on the flow rate of air clipped by the flow rate of air at the time of the full opening of the throttle valve 3. In this manner, the surplus amounts of the pulse widths, directly calculated by the flow rate of intake air (the curve A) measured by the AFS 2, are suppressed.

With the conventional fuel-injection control of the L-Jetronic type as described above, the flow rate of intake air measured by the AFS 2 and divided by the number of engine revolutions is utilized as the basic fuel-injection amount so that during a transitional operating state of the engine such as engine acceleration, it is difficult to control engine operation in accordance with the net flow rate of air actually sucked into the respective engine cylinders 7.

SUMMARY OF THE INVENTION

In view of the above, the present invention has the objective of overcoming the above-described problems of the prior art, and has for its main object the provision of a novel and improved system for controlling engine operation which is capable of determining the net flow rate of air actually sucked into the respective engine cylinders in a precise manner thereby to optimally control engine operation in accordance with the net flow rate of intake air even during transitional operating states of an engine.

In order to achieve the above object, according to one aspect of the present invention, there is provided an engine control system comprising:

an air-flow sensor for detecting the flow rate of intake air sucked into an engine;

an engine revolution-cycle sensor for detecting the cycle of engine revolutions;

a means for determining an average flow rate of intake air by sampling the flow rate of intake air detected by the air-flow sensor at the cycle detected by the engine revolution-cycle sensor; and a means for determining a net flow rate of intake air actually sucked into the engine as a parameter representative of an engine load on the basis of a predetermined formula in which the net flow rate of intake air to be determined is represented by means of the net flow rate of intake air previously determined by the use of the intrinsic volume of that portion of an intake passage downstream of a throttle valve, the compression ratio, the displacement of the engine, the average flow rate of intake air determined by the average flow-rate determining means, and the cycle of engine revolutions determined by the engine revolution-cycle sensor.

Preferably, the predetermined formula is expressed as follows:

$$E(n) = K \cdot \frac{T(n-1)}{T(n)} \cdot E(n-1) + (1-K) \cdot A(n)$$

where $$K = \frac{\frac{Vs}{Vh}\left(1 - \frac{1}{\epsilon}\right)}{1 + \frac{Vs}{Vh}\left(1 - \frac{1}{\epsilon}\right)}$$

the volume of the intake passage downstream of the throttle valve is represented by $V_s$, the engine displacement $V_h$, the compression ratio $\epsilon$, the average flow rate of intake air A(n), the engine revolution cycle T(n), the net flow rate of intake air E(n) to be determined, and the previous net flow rate of intake air E(n-1).

According to another aspect of the present invention, there is provided an engine control system comprising:

an air-flow sensor for detecting the flow rate of intake air sucked into an engine;

an engine revolution-cycle sensor for detecting the cycle of engine revolutions;

a means for determining an average flow rate of intake air by sampling the flow rate of intake air detected by the air-flow sensor at the cycle detected by the engine revolution-cycle sensor;

a means for determining a net flow rate of intake air actually sucked into the engine as a parameter representative of an engine load on the basis of a predetermined formula in which the net flow rate of intake air to be determined is represented by means of the net flow rate of intake air previously determined by the use of the intrinsic volume of that portion of an intake passage downstream of a throttle valve, the compression ratio, the displacement of the engine, the average flow rate of intake air determined by the average flow-rate determining means, and the cycle of engine revolutions determined by the engine revolution-cycle sensor;

an upper-limit determining means for determining an upper limit for the average flow rate of intake air;

a clipping means for clipping the average flow rate of intake air at the upper limit determined by the upper-limit determining means;

an engine acceleration sensor for detecting engine acceleration; and an inhibition means for inhibiting determination of the upper limit for the average flow rate of intake air until a predetermined number of ignition points or a predetermined period of time has passed from the instant when engine acceleration has been detected by the engine acceleration sensor.

Preferably, the predetermined formula is expressed as follows:

$$E(n) = K \cdot \frac{T(n-1)}{T(n)} \cdot E(n-1) + (1-K) \cdot A(n)$$

where $$K = \frac{\frac{Vs}{Vh}\left(1 - \frac{1}{\epsilon}\right)}{1 + \frac{Vs}{Vh}\left(1 - \frac{1}{\epsilon}\right)}$$

the volume of the intake passage downstream of the throttle valve is represented by $V_s$, the engine displacement $V_h$, the compression ratio $\epsilon$, the average flow rate of intake air A(n), the engine revolution cycle T(n), the net flow rate of intake air E(n) to be determined, and the previous net flow rate of intake air E(n-1).

According to a further aspect of the present invention, there is provided an engine control system comprising:

an air-flow sensor for detecting the flow rate of intake air sucked into an engine;

an engine revolution-cycle sensor for detecting the cycle of engine revolutions;

a means for determining an average flow rate of intake air by sampling the flow rate of intake air detected by the air-flow sensor at the cycle detected by the engine revolution-cycle sensor; and a means for determining charging efficiency of intake air as a parameter representative of an engine load on the basis of a predetermined formula in which the charging efficiency to be determined is represented by means of the charging efficiency previously determined by the use of the intrinsic volume of that portion of an intake passage downstream of a throttle valve, the compression ratio, the displacement of the engine, the standard density of the atmosphere, the average flow rate of intake air determined by the average flow-rate determining means, and the cycle of engine revolutions determined by the engine revolution-cycle sensor.

Preferably, the predetermined formula is expressed as follows:

$$CE(n) = K \cdot CE(n-1) + (1-K) \cdot A(n) \cdot T(n) \cdot K_A$$

where $$K = \frac{\frac{V_S}{V_h}\left(1-\frac{1}{\epsilon}\right)}{1+\frac{V_S}{V_h}\left(1-\frac{1}{\epsilon}\right)}, K_A \frac{1}{V_h \cdot \rho_o}$$

the volume of the intake passage downstream of the throttle valve is represented by $V_s$, the engine displacement $V_h$, the compression ratio $\epsilon$, the average flow rate of intake air A(n), the standard desity of the atmosphere $\rho_o$, the engine revolution cycle T(n), the charging efficiency CE(n) to be determined, and the previous charging efficiency CE(n-1).

According to a still further object of the present invention, there is provided an engine control system comprising:

an air-flow sensor for detecting the flow rate of intake air sucked into an engine;

an engine revolution-cycle sensor for detecting the cycle of engine revolutions;

a means for determining an average flow rate of intake air by sampling the flow rate of intake air detected by the air-flow sensor at the cycle detected by the engine revolution-cycle sensor;

a means for determining charging efficiency of intake air as a parameter representative of an engine load on the basis of a predetermined formula in which the charging efficiency to be determined is represented by means of the charging efficiency previously determined by the use of the intrinsic volume of that portion of an intake passage downstream of a throttle valve, the compression ratio, the displacement of the engine, the standard density of the atmosphere, the average flow rate of intake air determined by the average air-flow determining means, and the cycle of engine revolutions determined by the engine revolution-cycle sensor;

an upper-limit determining means for determining an upper limit for the average flow rate of intake air;

a clipping means for clipping the average flow rate of intake air at the upper limit determined by the upper-limit determining means;

an engine acceleration sensor for detecting engine acceleration; and an inhibition means for inhibiting determination of the upper limit for the average flow rate of intake air until a predetermined number of ignition points or a predetermined period of time has passed from the instant when engine acceleration has been detected by the engine acceleration sensor.

Preferably, the predetermined formula is expressed as follows:

$$CE(n) = K \cdot CE(n-1) + (1-K) \cdot A(n) \cdot T(n) \cdot K_A$$

where

-continued $$K = \frac{\frac{VS}{Vh}\left(1-\frac{1}{\epsilon}\right)}{1+\frac{V_S}{Vh}\left(1-\frac{1}{\epsilon}\right)}, KA \frac{1}{Vh \cdot \rho o}$$

the volume of the intake passage downstream of the throttle valve is represented by $V_s$, the engine displacement $V_h$, the compression ratio $\epsilon$, the average flow rate of intake air A(n), the standard density of the atmosphere $\rho_o$, the engine revolution cycle T(n), the charging efficiency to be determined CE(n), and the previous charging efficiency CE(n-1).

The above and other objects, features and advantages of the present invention will become apparent from the following detailed description of several presently preferred embodiments of the invention when taken in conjunction with the accompanying drawings.

DESCRIPTION OF PREFERRED EMBODIMENTS

Now, the present invention will be described in detail with reference to several preferred embodiments as illustrated in the accompanying drawings.

Figure 7:
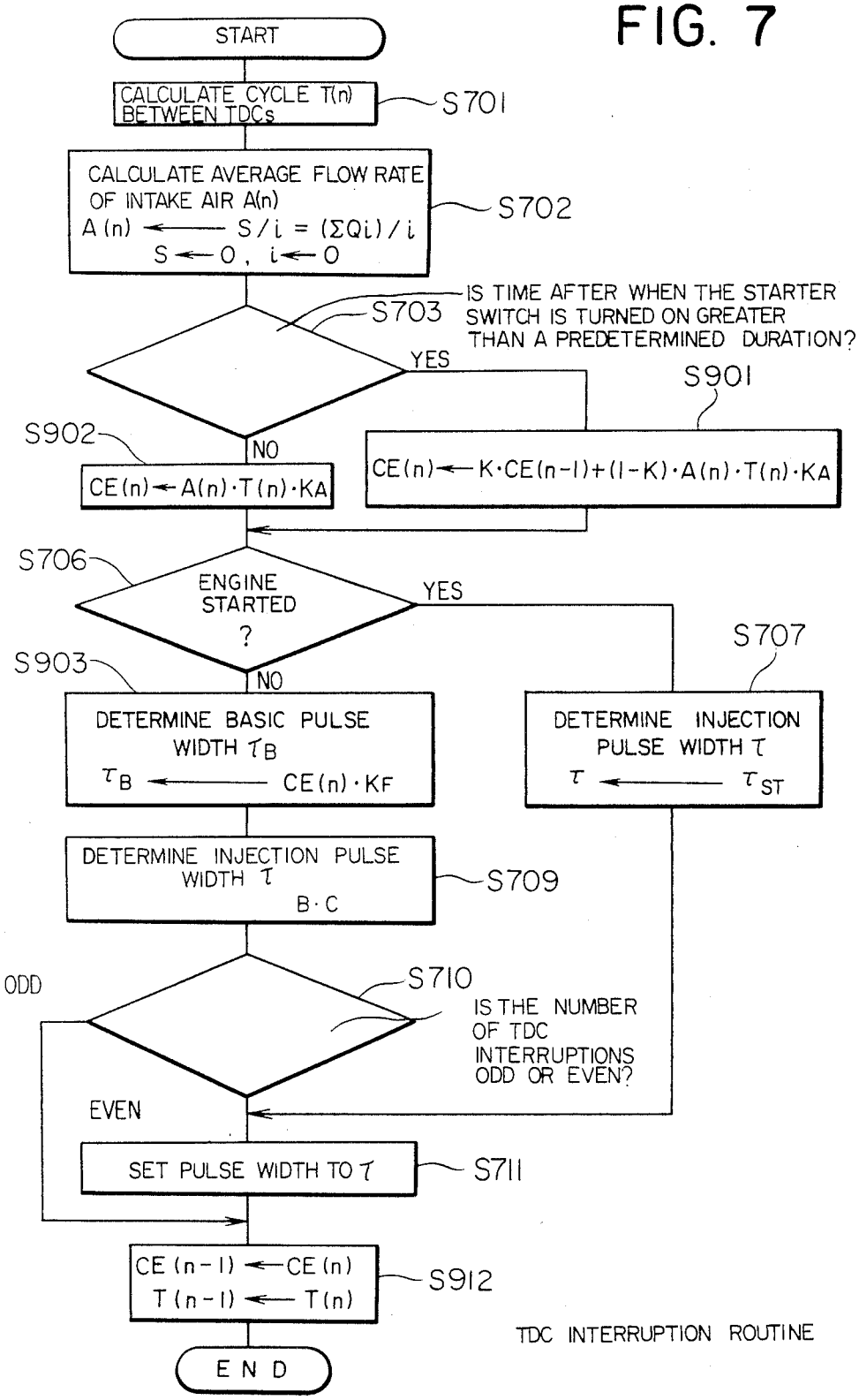
Figure 8:
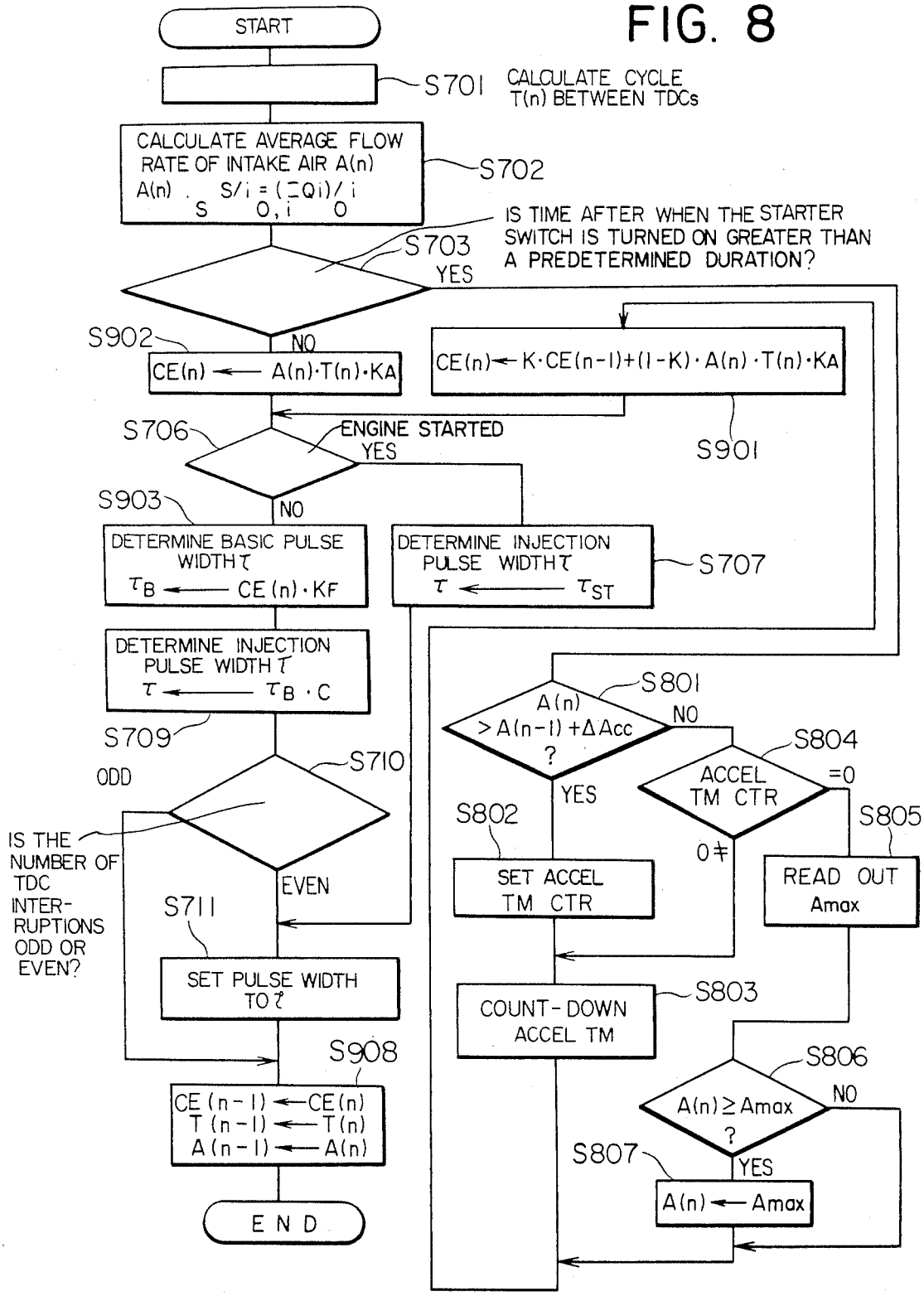
Figure 9:
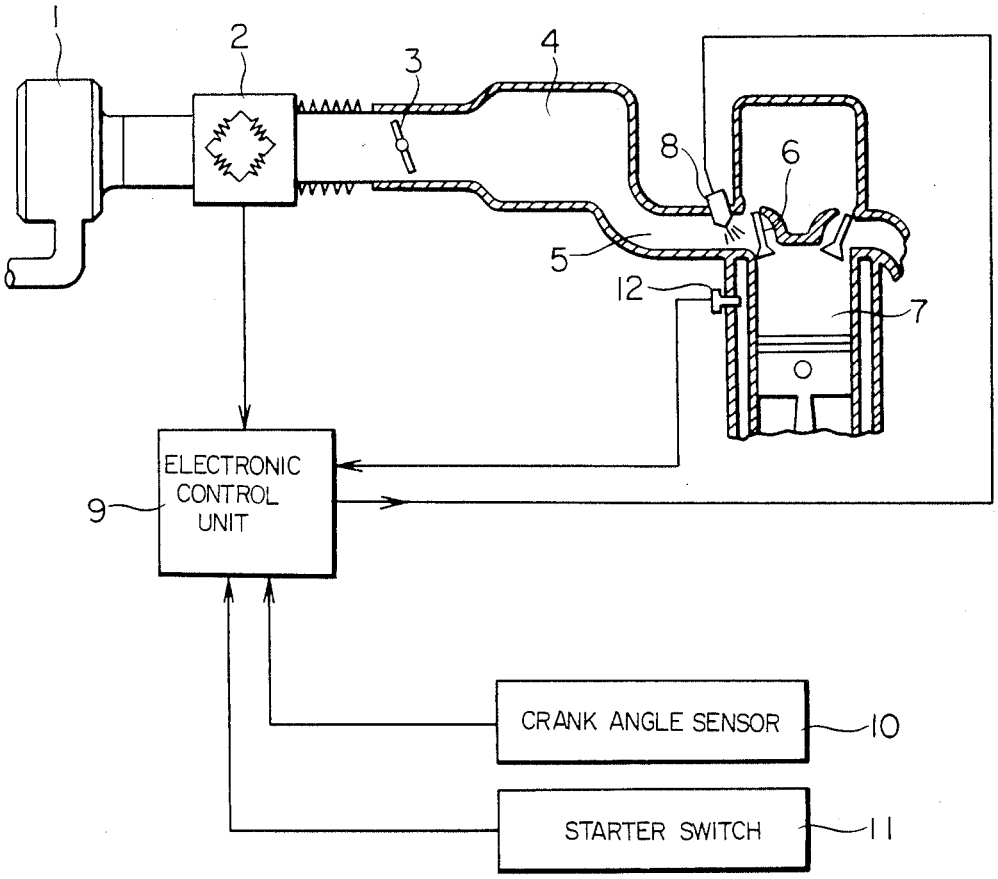
FIG. 9 is a schematic view, in partial cross section, of a hardware arrangement of a fuel injection system employing an AFS which is applicable to the prior art and the present invention.

In the following description, the present invention is applied to an internal combustion engine having a general arrangement as illustrated in FIG. 9 with the exception that the present invention employs a novel ECU 90 having different control processes which includes a hardware arrangement illustrated in FIG. 1 and software arrangements illustrated in FIGS. 2 through 4 and FIGS. 6 through 8, respectively.

Figure 1:
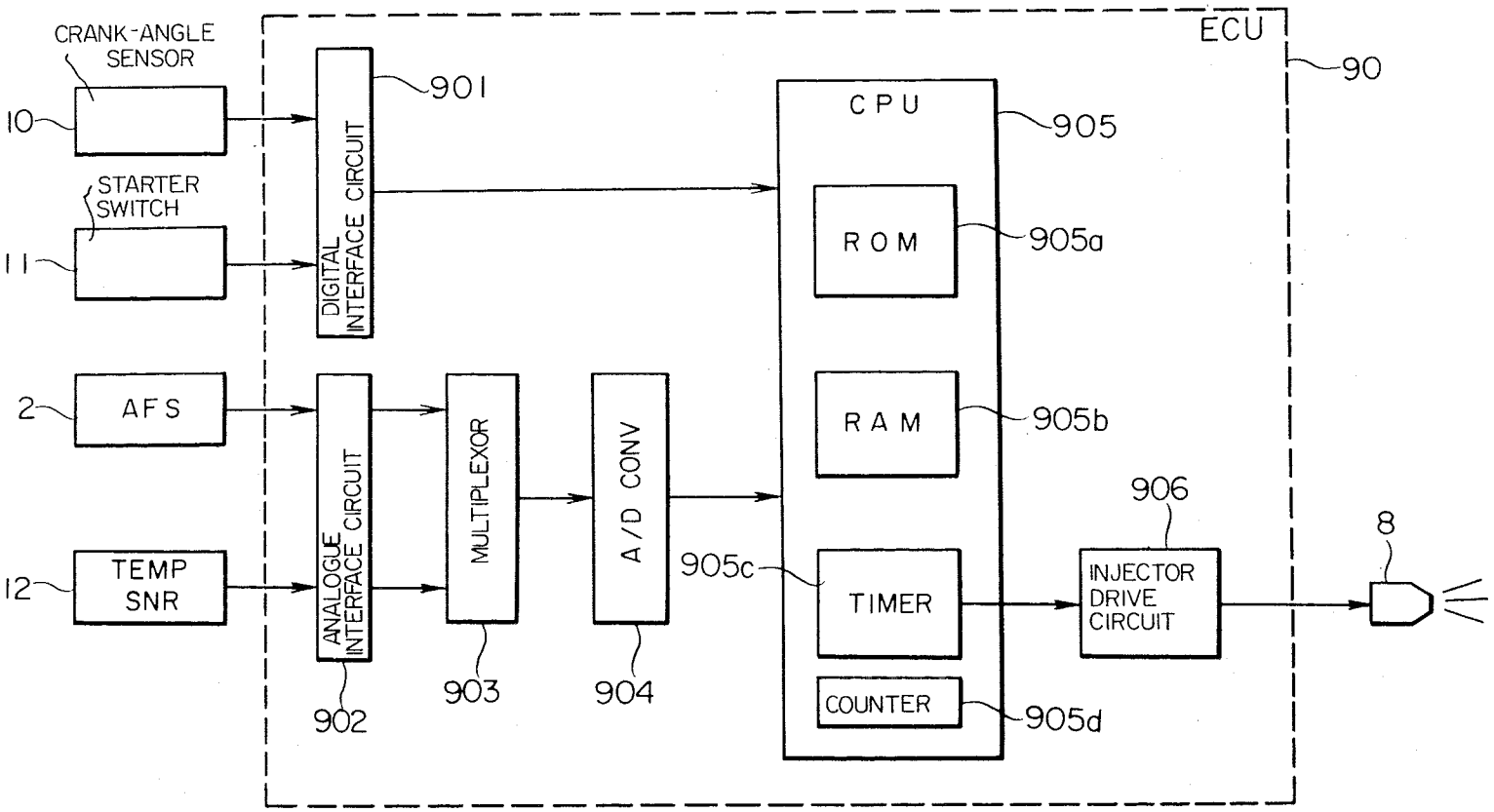
FIG. 1 is a block diagram of hardware of an ECU constructed in accordance with the present invention for common use with all the embodiments of the present invention.
Figure 10:
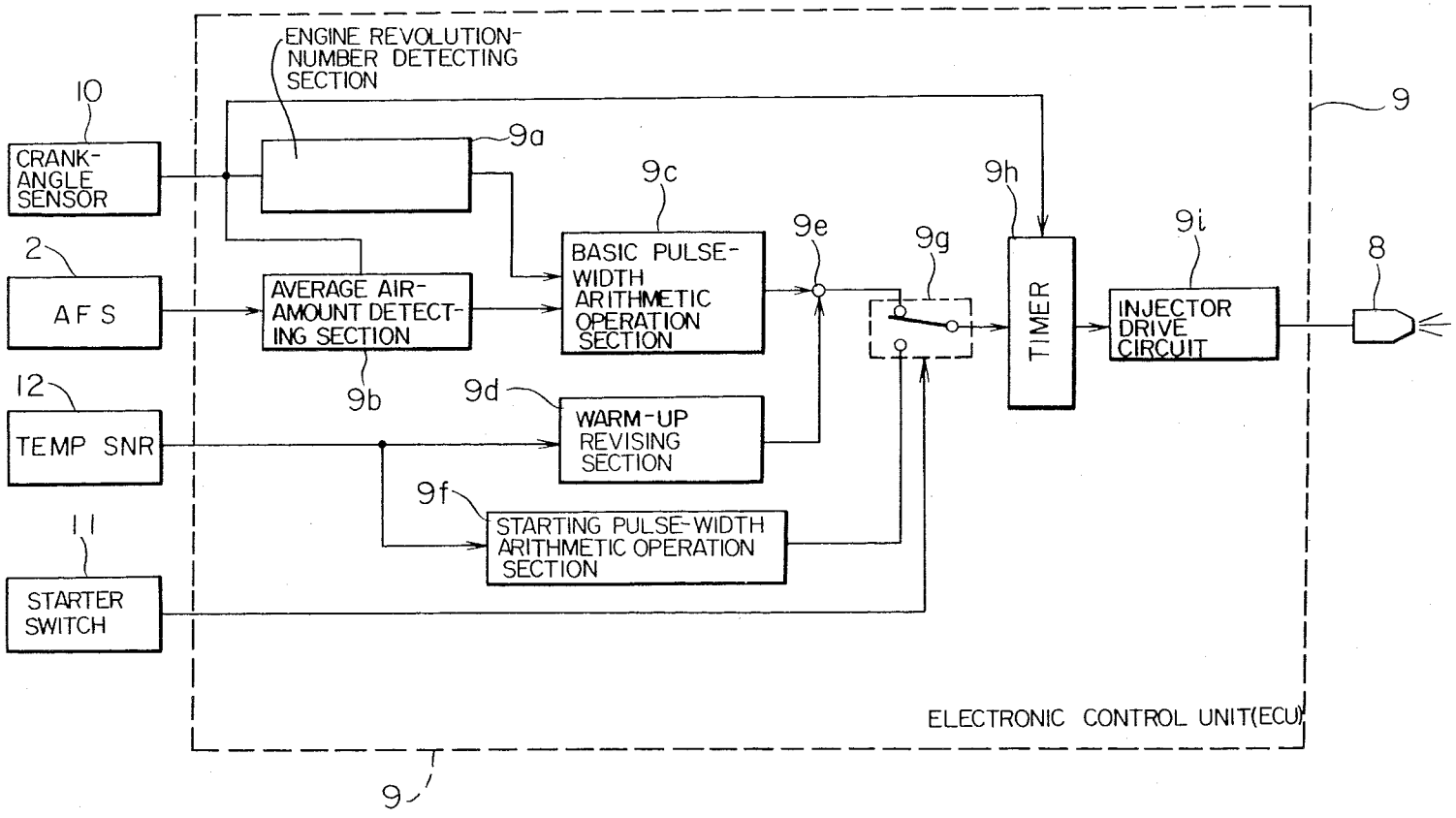
FIG. 10 PRIOR ART
FIG. 10 is a block diagram showing hardware of a conventional ECU for use with the fuel injection system illustrated in FIG. 9.

In FIG. 1, the ECU 90 illustrated comprises a digital interface circuit 901 adapted to be input with digital signals from a crank-angle sensor 10 and a starter switch 11; an analogue interface circuit 902 adapted to be input with analogue signals from an AFS 2 and a temperature sensor 12; a multiplexor 903; an A/D converter 904 for successively converting the analogue signals, fed from the AFS 2 and the temperature sensor 12 through the analogue interface 902 and the multiplexor 903, into digital signals; a CPU 905 having a ROM 905*a*, a RAM 905*b*, a timer 905*c* and a counter 905*d* and adapted to calculate an appropriate width for a fuel injection pulse by a programmed operation illustrated in FIGS. 2 to 4 and FIGS. 6 to 8 on the basis of signals input from the digital interface circuit 901 and the A/D converter 904; and an injector drive circuit 906 for driving the respective fuel injectors 8 at the pulse width calculated by the CPU 905. The injector drive circuit 906 may be the one shown by 9*i* in FIG. 10.

Before describing the operations of the respective embodiments of the present invention, the operational principles of the invention common to all the embodiments illustrated will be described below.

First, the following definitions are given for the purpose of dealing with the nth cycle event with adjacent TDCs being taken as one cycle.

| | | |
|---|---|---|
| cycle between TDCs | T(n) | [s] |
| average air flow rate between TDCs measured by AFS | A(n) | [g/s] |
| average boost pressure in intake passage downstream of throttle valve between TDCs | P(n) | [atm] |
| flow rate of air sucked into cylinders between TDCs | E(n) | [g/s] |
| average temperature of intake air at inlet portions (intake manifold) of respective cylinders between TDCs | $t_i(n)$ | [°K.] |
| average temperature of exhaust gas between TDCs | $t_r(n)$ | [°K.] |
| average pressure of exhaust gas between TDCs | $P_r(n)$ | [atm] |

In this case, the following constants are required:

| | | |
|---|---|---|
| volume of intake passage downstream of throttle valve (surge tank and intake manifold) | $V_s$ | [l] |
| displacement per cylinder | $V_h$ | [l] |
| standard density of atmosphere [1 atm, 293° K., 1 l] | $\rho_o$ | [g/l] |
| compression ratio | $\epsilon$ | |

In this case, the flow rate of air E(n) sucked into the respective engine cylinders at the nth cycle is expressed as follows:

$$E(n) = \rho_o \cdot \frac{P(n) \cdot Vh}{t_i(n)} \cdot \eta_v \cdot \frac{1}{T(n)} \tag{1}$$

where $\eta_v$ is a volumetric efficiency which is expressed as follows:

$$\eta_v = \frac{\epsilon}{\epsilon - 1}\left(1 - \frac{Pr(n)}{p(n)} \cdot \frac{1}{\epsilon} \cdot \frac{t_i(n)}{t_r(n)}\right) \tag{2}$$

Then, an increase in the flow rate of air in the portion of the intake passage of a volume $V_s$ downstream of the throttle valve 3 is equal to an average air flow rate A(n) which is measured by the AFS 2 and subtracted by the flow rate of air sucked into the respective engine cylinders 7, and hence such an increased air flow rate is expressed as follows:

$$\rho o \cdot \frac{\{P(n) - P(n-1)Vs\}}{t_i(n)} = \{A(n) - E(n)\} \cdot T(n) \tag{3}$$

If the equations (1) and (2) are solved for P(n), $$P(n) = \frac{\epsilon - 1}{\epsilon} \cdot \frac{ti(n)}{\rho_o \cdot Vh} \cdot T(n) \cdot E(n) + \frac{Pr(n)}{\epsilon} \cdot \frac{tr(n)}{ti(n)} \tag{4}$$

For the (n−1)th cycle, the equation (4) above is as follows:

$$P(n-1) = \frac{\epsilon - 1}{\epsilon} \cdot \frac{ti(n-1)}{\rho_o \cdot Vh} \cdot T(n-1) \cdot E(n-1) + \frac{Pr(n-1)}{\epsilon} \cdot \frac{tr(n-1)}{ti(n-1)} \tag{5}$$

Entering the equations (4) and (5) into the equation (3), the flow rate of air E(n) is given as follows.

$$E(n) = \frac{\frac{Vs}{Vh}\left(1 - \frac{1}{\epsilon}\right)}{1 + \frac{Vs}{Vh}\left(1 - \frac{1}{\epsilon}\right)} \cdot \frac{T(n-1)}{T(n)} \cdot E(n-1) + \frac{1}{1 + \frac{Vs}{Vh}\left(1 - \frac{1}{\epsilon}\right)} \cdot A(n) + \frac{1}{1 + \frac{Vs}{Vh}\left(1 - \frac{1}{\epsilon}\right)} \cdot \frac{\rho_o \cdot V_s}{\epsilon} \cdot \left\{\frac{Pr(n-1) \cdot tr(n-1)}{ti(n-1)} - \frac{Pr(n) \cdot tr(n)}{ti(n)}\right\} \tag{6}$$

Since the change rates of the temperature and the pressure of exhaust gas between TDCs are by far smaller than those for the average air flow A(n), the boost pressure P(n), the air flow rate E(n) and the cycle T(n), it follows that in the equation (6), $t_i(n-1) \approx t_i(n)$; $t_r(n-1) \approx t_r(n)$; and $P_r(n-1) \approx P_r(n)$. Therefore, the third term in the equation (6) can be neglected so that the equation (6) can be approximated as follows:

$$E(n) = K \cdot \frac{T(n-1)}{T(n)} \cdot E(n-1) + (1 - K) \cdot A(n) \tag{7}$$

where $$K = \frac{\frac{Vs}{Vh}\left(1 - \frac{1}{\epsilon}\right)}{1 + \frac{Vs}{Vh}\left(1 - \frac{1}{\epsilon}\right)}$$

K being a constant determined according to the engine.

Accordingly, from the equation (7) above, it can be seen that the flow rate of air E(n) sucked into the respective engine cylinders 7 is obtained from the constant K, the average air flow rate A(n) measured by the AFS, and the engine revolution cycle T(n).

Then, when charging efficiency CE(n) of intake air is taken for the flow rate of air sucked into the respective engine cylinders, it is expressed as follows.

$$CE(n) = \frac{E(n) \cdot T(n)}{Vh \cdot \rho_o} \quad (8)$$

If entering the equation (8) above into the equation (7), the following equation (9) is obtained.

$$CE(n) = K \cdot CE(n-1) + (1-K) \cdot A(n) \cdot T(n) \cdot K_A \quad (9)$$

where $$K_A = \frac{1}{Vh \cdot \rho_o}$$

Here, it is to be noted that the charging efficiency CE(n) does not include any divided terms and thus it is much more convenient in terms of processing speed. Also, since the parameter of the charging efficiency CE(n) can be utilized as a parameter representative of the engine load, a basic air/fuel ratio map in a fuel-injection system, for example, is usable for a two-dimensional map between the number of engine revolutions and the charging efficiency.

Now, the operation of the first embodiment of the present invention will be described in detail with reference to flow charts illustrated in FIGS. 2 through 4.

Figure 2:
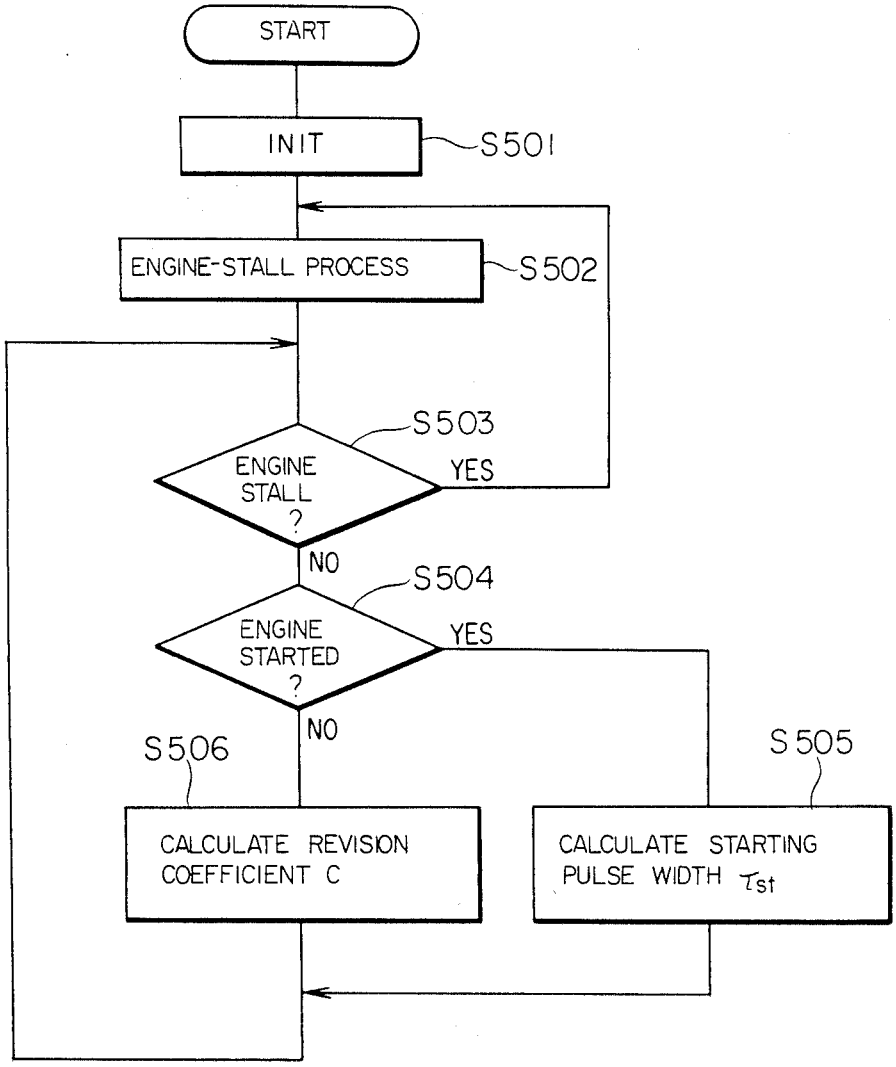
FIGS. 2 and 3 are block diagrams of control programs respectively showing a main routine and a 1 ms interruption routine for operating the ECU in FIG. 1.

FIG. 2 shows a main routine in which after a key (not shown) is turned on to supply electrical power, the system is initialized at step S501. At step S502, an engine-stall process is effected and then at step S503, judgment on the engine stall is made. If the engine stalls, the system returns to step S502 so that the processes at steps S502 and S503 are repeated until the engine stall is remedied. If the engine is not stalled, judgment on engine starting is then made at step S504 according to the state of the starter switch 11 so that if it is judged that the engine is at a starting period, a starting pulse width $\tau_{ST}$ is determined at step S505 on the basis of the temperature of engine coolant detected by the temperature sensor 12 (FIG. 9), similar to the aforementioned control system illustrated in FIG. 10, and then the system returns to step S503. On the other hand, if it is judged that the engine has not started, at step S504, the system operates to calculate various revision coefficients C such as a warming-up coefficient and then returns to step S503. Thereafter, during engine operation, the processes from step S503 to step S506 are carried out in a repeated manner.

Figure 3:
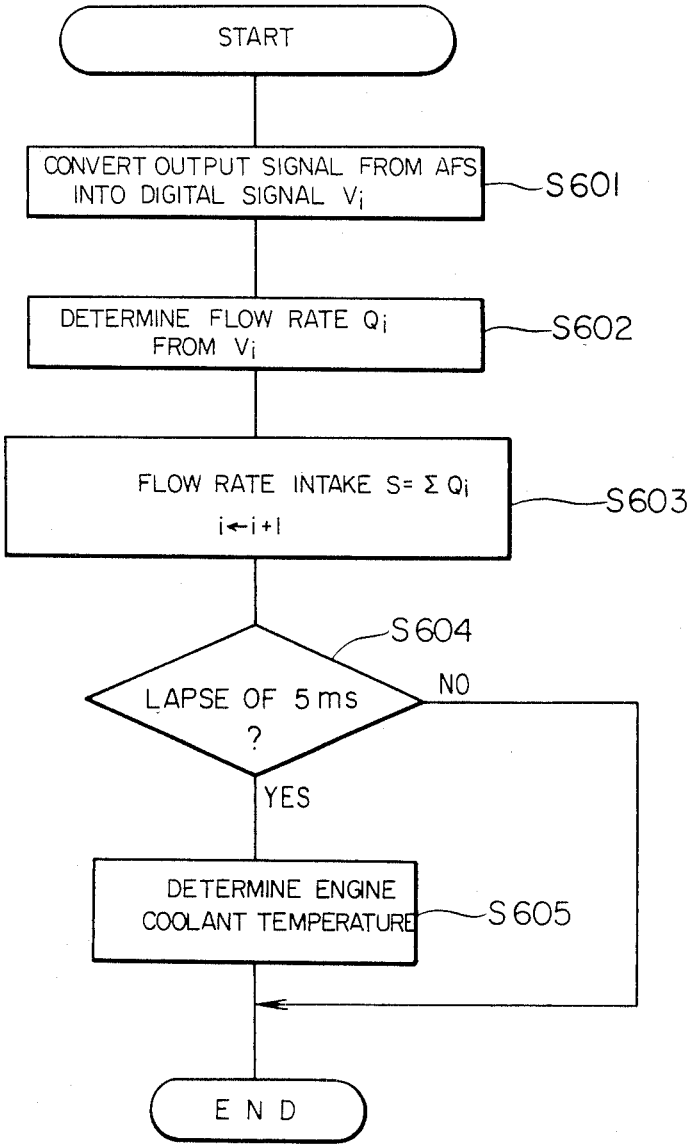

FIG. 3 shows an interruption routine per 1 ms in which at step S601, the output signal from the AFS 2 is input through the analogue interface 902 and the multiplexor 903 to the A/D converter 904 where it is converted into a digital signal having a voltage $V_i$ by an A/D conversion. Subsequently, at step S602, an appropriate flow rate $Q_i$ is determined from the voltage $V_i$ by means of a conversion table stored in the ROM 905*a*. Then, at step S603, a flow rate of intake air $Q_i$ for every 1 ms is calculated by integration and the flow rates thus obtained are saved as "S" in the ROM 905*b* with the number of integrations being also saved as "i" in the ROM 905*b*. In this connection, it is to be noted that the steps S604 and S605 are to convert an engine-coolant temperature signal representative of the temperature of engine coolant which is in the form of an analogue signal other than the AFS signal.

Figure 4:
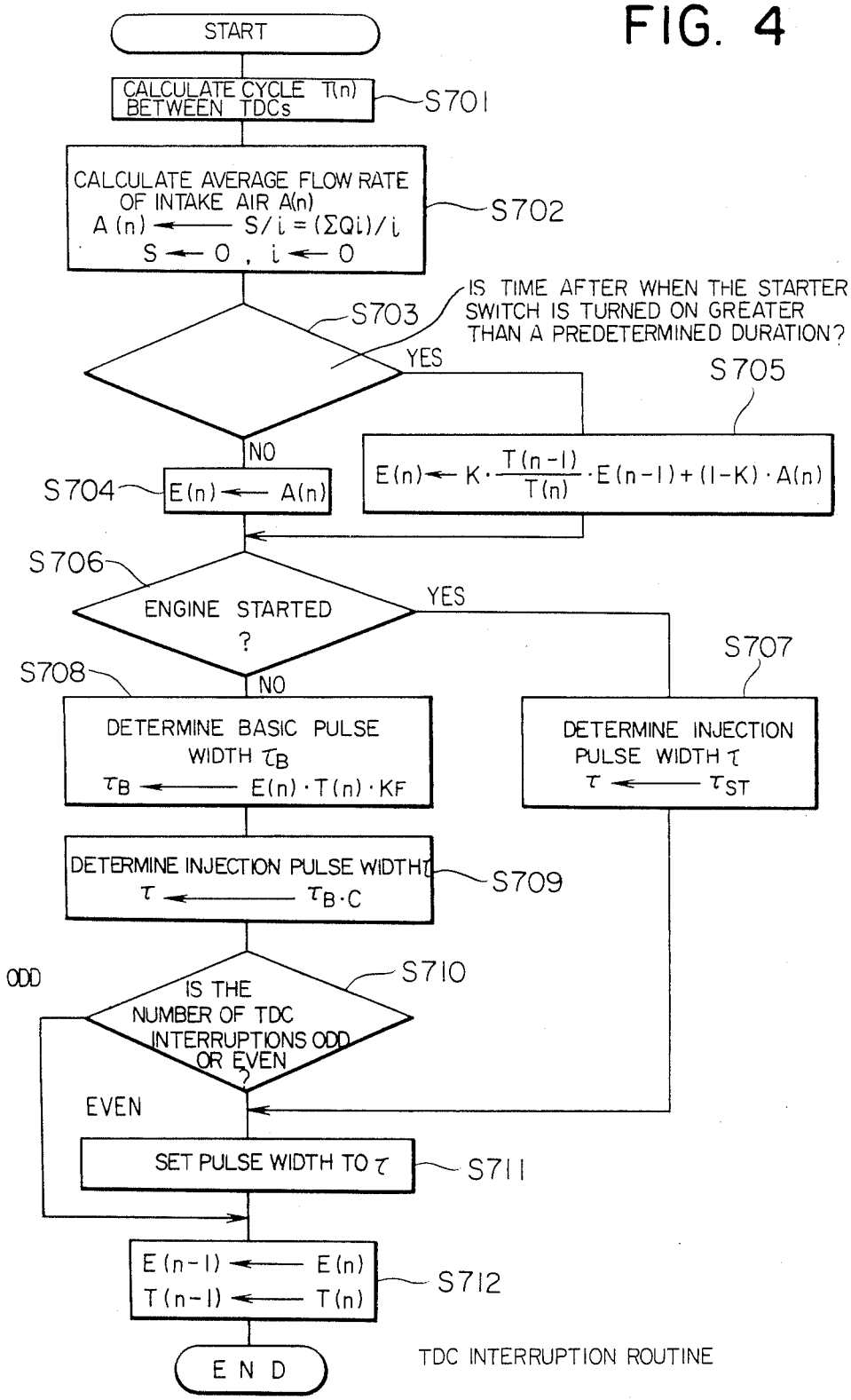
FIG. 4 is a flow chart of a control program showing a TDC interruption routine for carrying out a first embodiment of the present invention.

FIG. 4 shows an interruption processing routine per TDC of the crank-angle signal in which at step S701, a cycle T(n) between adjacent TDCs is calculated. At step S702, the flow rate of intake air S, calculated by integration according to the 1 ms interruption processing routine as illustrated in FIG. 3, is divided by the times of integrations i so as to provide an average flow rate of intake air A(n) between adjacent TDCs, and then the memory in the RAM 905*b* storing these values S and i is reset. Subsequently, at step S703, it is judged whether or not a predetermined period of time has elapsed after the key (not shown) is turned on to supply electrical power, and if not, the system proceeds to step S704 where the net flow rate of intake air E(n), sucked into the respective engine cylinders, is set to the average flow rate of intake air A(n) measured by the AFS. On the other hand, if it is judged that the predetermined period has elapsed, the system proceeds to step S705 where the net flow rate of intake air E(n) is determined from the aforesaid equation (7) by using the A(n), E(n−1), T(n), T(n−1) and K as already determined. At step S706, it is judged whether or not the engine is being started, and if so, the system proceeds to step S707 where the starting pulse width $\tau_{ST}$, already determined by the main routine as illustrated in FIG. 2, is loaded as an injection pulse width $\tau$ into the RAM 905*b*.

At step 706, if it is judged that the engine is not in a starting condition, then the system proceeds to step S708 where an arithmetic operation for determining a basic pulse width ($\tau_B$=E(n).T(n).$K_F$) is carrried out. In this connection, $K_F$ is a constant which is determined according to the fuel injection characteristics of the respective fuel injectors 8. Thereafter, at step S709, an injection pulse width $\tau$ is determined from an equation $\tau=\tau_B$.C (C: constant), as with the warming-up revising section 9*d*. A step S710 is for when there is simultaneous injection of all the fuel injectors 8 where odd or even judgment is effected in order that fuel can be injected from the respective fuel injectors 8 into all the engine cylinders at a rate of one fuel injection for every two TDC interruptions. At step S711, the injection pulse width $\tau$, obtained at step 709, is set into the timer 905*c*. Subsequently, at step S712, the E(n) and T(n) previously obtained are set into the ROM 905*b* as E(n−1) and T(n−1) for the next TDC interruption. In this regard, it is to be noted that the processes at steps S701, S702, and S706 through S709 are the same as those in the case of FIG. 10.

Figure 5:
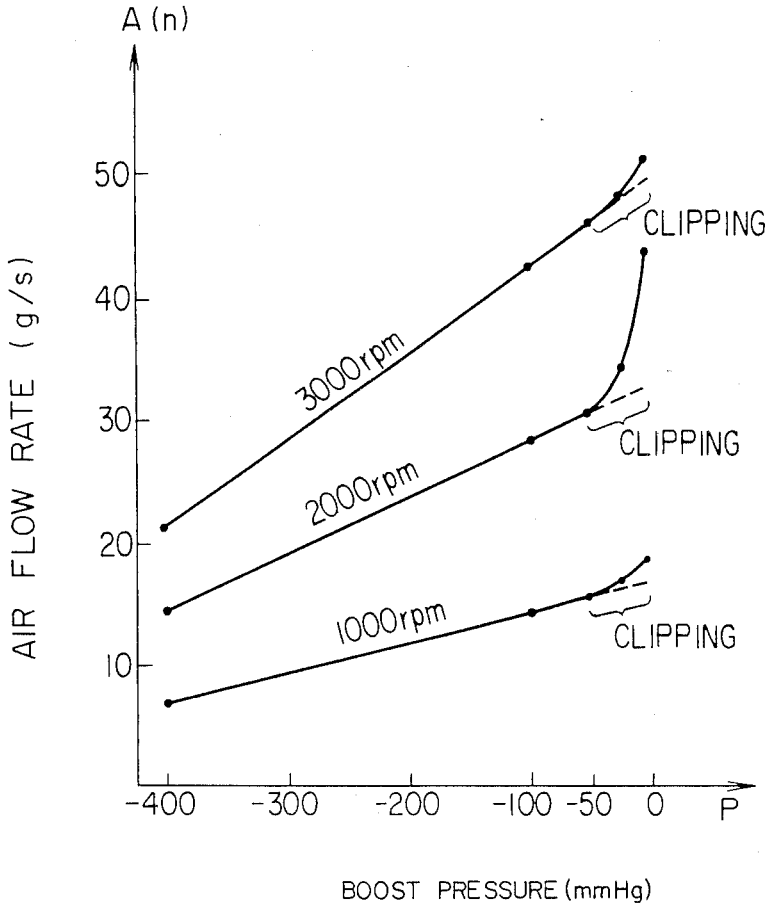
FIG. 5 is a graphic representation describing prohibition of clipping processing in relation to a second and a third embodiment of the present invention.

On the other hand, there may be a case in which the AFS 2 makes erroneous measurements due to pulsation or blowback of intake air in a low-speed, high-load range (for example, 1,000 to 3,000 rpm and 50 mm Hg to 0 mm Hg when there is no turbocharger) during engine operation. FIG. 5 shows such a case in which the output of the hot-wire type AFS 2 is sampled every 1 ms and then converted into a flow rate which is represented on ordinate, and the flow rate thus obtained is averaged per one intake stroke of the engine so as to provide a boost pressure which is represented on abscissa with engine rpm being taken as a parameter. As illustrated in FIG. 5, in the above-mentioned low-speed, high-load operation range of the engine, the flow rate of intake air A(n) takes a considerably large value due to blowback of intake air. In order to prevent this, it is considered to set an upper limit for the respective numbers of engine revolutions at the flow rate of intake air having a boost pressure P=0 mm Hg or a predetermined charging efficiency of intake air (for example, 0.9) on the linear extensions of the respective flow-rate to boost-pressure characteristic lines, as illustrated by broken lines in FIG. 5, so as to clip the flow rate of intake air.

Accordingly, by taking the flow rate of intake air thus clipped for the flow rate of intake air A(n) in the equation (7), an appropriate flow rate of intake air will be obtained if the engine is in a steady operating condition even in the above low-speed, high-load operation range.

Figure 11:
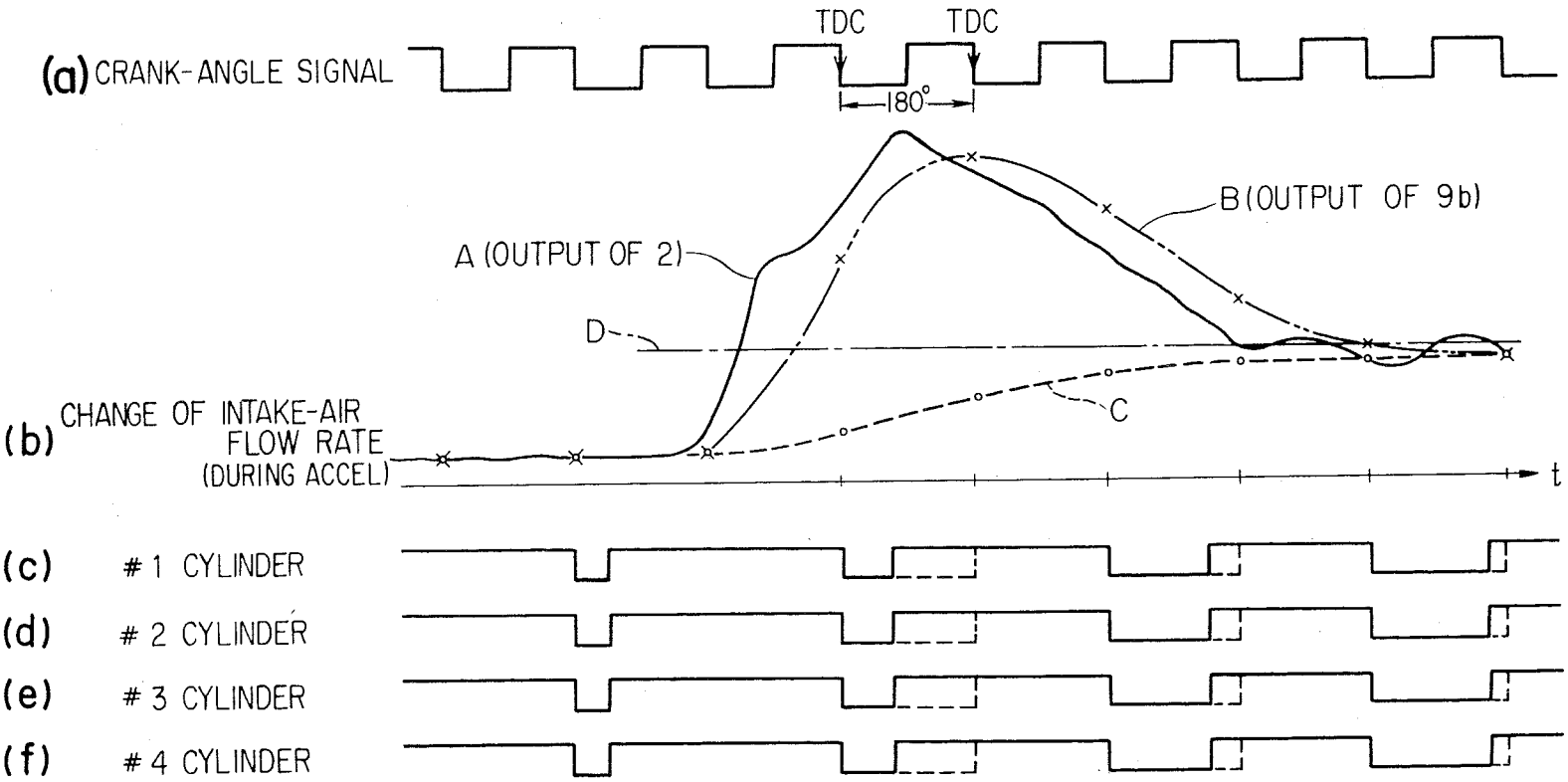
FIG. 11 PRIOR ART
FIG. 11 is a view showing various wave forms for describing arithmetic operations for determining a basic amount of fuel injection injected by respective fuel injectors.

During a transitional period such as engine acceleration, however, an overshoot phenomenon of the intake air flow rate, as illustrated in FIG. 11, will appear, as referred to in the foregoing. If the above-described clipping process is carried out at such an occasion, the above equation (7) will lose its intended role. That is, it will be difficult to determine an appropriate flow rate of intake air in such a manner as to meet the requirements of the engine upon acceleration.

To avoid such a situation, according to the present invention, the above clipping process is not carried out during a predetermined ignition interval in which the normal clipping operation continues from the instant when normal judgment on engine acceleration has been made based on a changed rate of flow of intake air A(n) or a changed rate of the throttle valve opening speed, or during a predetermined period of time (for example, a period of 0.1 to 0.2 seconds in which the curve A or B is above a clipping curve D in FIG. 11), so that an appropriate flow rate of intake air can always be determined during the steady-state operation of the engine in the low-speed, high-load range as well as at the transitional operation period of the engine.

Figure 6:
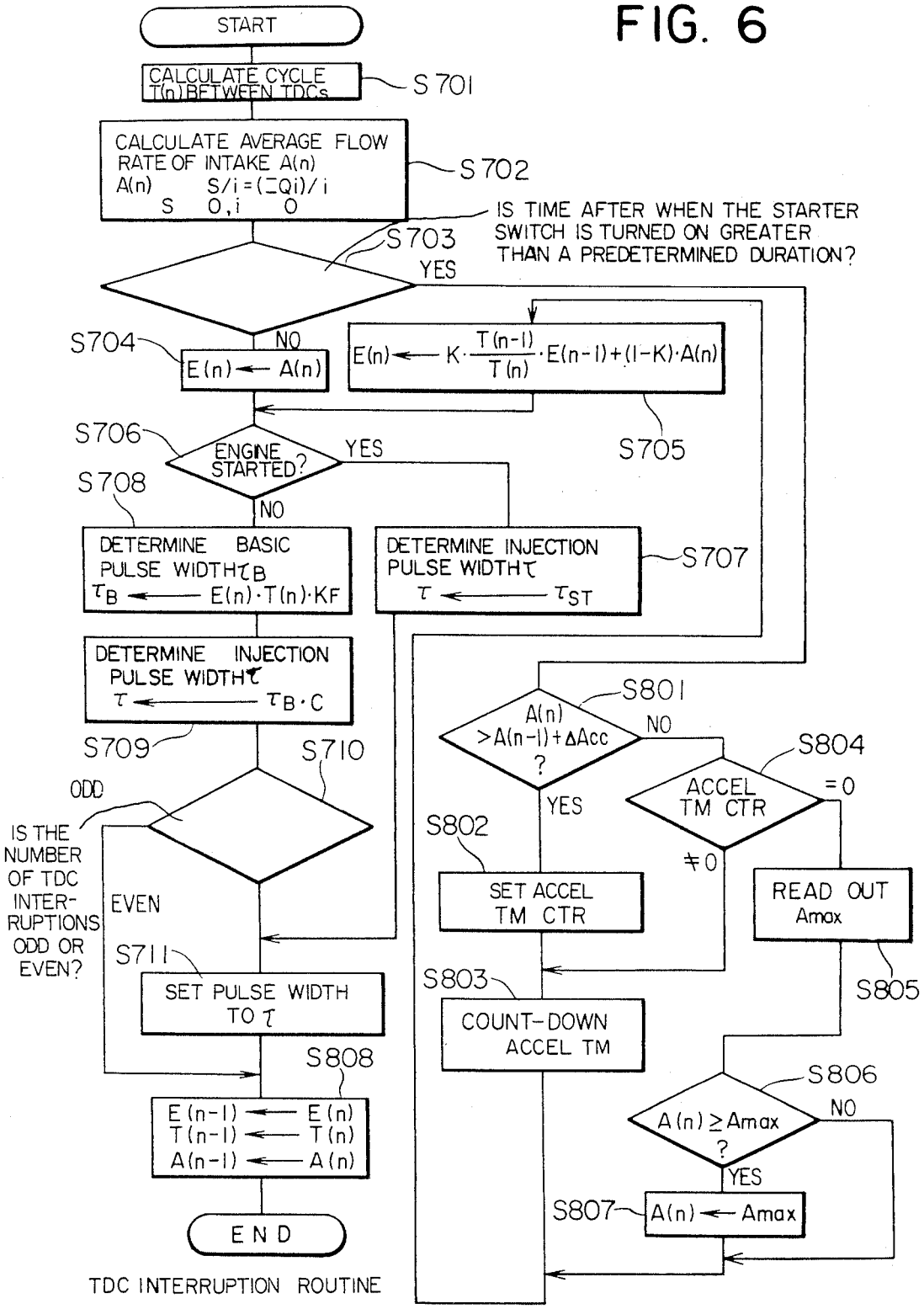
FIGS. 6 through 8 are flow charts of control programs respectively showing different TDC interruption routines for carrying out the second and third embodiments of the invention.

FIG. 6 shows a flow chart for describing the above control process which differs from that illustrated in FIG. 4 in the features that between steps S703 and S705 in FIG. 4, steps S801 through S806 are inserted, and that step S712 in FIG. 4 is partially changed.

Now, describing the different steps in detail, at step S801, judgment on engine acceleration is effected in which Acc shows the necessary increase of engine acceleration. If certain conditions are satisfied and it is judged that the engine is accelerating, at step S802 the counter 905*d* is set for the acceleration time period corresponding to the above-mentioned predetermined time. At step S803 the counter 905*d* counts down a predetermined amount corresponding to the above acceleration time. On the other hand, at step S801, if it is judged that the engine is not in an accelerating state, then at step S804 it is judged whether or not the acceleration time counter 905*d* has reset (count number=0) and if not, the system judges that the engine is accelerating, and proceeds to step S803. On the other hand, if the counter 905*d* has reset, engine acceleration has been finished or the engine is not in an accelerating state and in this case, at step S805, the data stored in the ROM 905*a* (corresponding to that shown by broken lines in FIG. 5), is read so as to determine an upper limit of the flow rate of intake air $A_{max}$ which is then compared with the flow rate of intake air A(n) detected by the AFS 2 at step S806. If A(n) is equal to or larger than $A_{max}$, at step S807, the flow rate of intake air A(n) is clipped at $A_{max}$, and if A(n) is smaller than $A_{max}$, it is not clipped. In this manner, the system or the control program proceeds to step S705.

Thereafter, the system carries out the processes from step S706 to Step S711, similar to those in FIG. 4, and proceeds to step S808 where the flow rate of intake air A(n) thus determined is set into the RAM 905*b* as A(n−1) for the subsequent TDC interruption.

Although in the above-described control programs as illustrated in FIGS. 2 through 4 and FIG. 6, the flow rate of intake air sucked into the respective engine cylinders is taken as an engine load parameter, it is possible to determine the amount of fuel to be injected from each fuel injector on the basis of charging efficiency of intake air in place of the flow rate of intake air, as referred to in the previous description of the operational principles of the invention. To this end, FIG. 7 shows a further control process of the invention which differs from that illustrated in FIG. 4 mainly in that at steps S901, S902 S903 and S912, arithmetic operations are carried out in relation to the aforementioned equations (8) and (9) using the air intake parameter of charging efficiency. In step S912, the CE(n) and T(n) are stored in ROm 9056 as CE(n−1) and T(n−1), respectively, and used as the charging efficiency and engine revolution cycle of a preceding TDC interruption for the determination of the injection pulse width of the next TDC interruption. The processes in this embodiment other than the above are the as those in FIG. 4.

FIG. 8 shows a still further embodiment of the present invention which differs from that illustrated in FIG. 7 mainly in that the clipping processes from step S801 to step S807, similar to those shown in FIG. 6, are added. The remaining processes of this embodiment are substantially the same as those in FIG. 7.

Although in the above-described embodiments, the cylinder volume or displacement $V_h$, the volume of the portion of the intake passage downstream of the throttle valve $V_s$, and the compression ratio $\epsilon$ are employed as basic engine parameters, the temperature of the intake manifold $t_i(n)$ and the temperature of exhaust gas $t_r(n)$ may be added so as to provide a more precise model, as represented by the equation (6).

Also, in the above embodiments, various processes are carried out between adjacent TDCs, but instead they may be effected between adjacent ignition points with the same results obtained.

Further, in the above embodiments, the AFS is of the hot-wire type, but instead it may be of other types such as vane or Karman type.

In cases where there is no provision for a surge tank, for example, in the case of a fuel injection system of a single-point injection type, the same results will be obtained if the volume of that portion of the intake passage downstream of a throttle valve is not negligible.

Although in the above-described embodiments, a fuel injection system is taken for the sake of description, the present invention is also applicable to other types of engine control systems such as an ignition control system (that is a system for controlling engine operation by means of ignition timing which is a function of E(n) and T(n)), a supercharged-pressure control system (that is optimization control of the supercharged pressure based on E(n)) or the like.

As apparent from the foregoing, the present invention provides the following advantages.

A net flow rate of intake air actually sucked into respective engine cylinders or charging efficiency of intake air is determined by arithmetic operations so that precise and optimal control on engine operation can be made even at transitional operating conditions of the engine. Moreover, during transitional conditions of the engine such as engine acceleration in the low-speed, high-load operation range, the fuel-injection control system appropriately operates without taking any clipping action whereby a precise flow rate of intake air actually sucked into the respective engine cylinders can be obtained even during transitional operating periods, thus enabling optimal control of engine operation.

What is claimed is:

1. An engine control system comprising:

an air-flow sensor detecting a flow rate of intake air sucked into an engine through an intake passage;

an engine revolution-cycle sensor detecting a cycle of engine revolutions;

a first means for determining an average flow rate of intake air by sampling the row rate of intake air detected by said air-flow sensor at the cycle detected by said engine revolution-cycle sensor;

a second means for determining net flow rate of intake air actually sucked into the engine as an intake air parameter representative of an engine load on the basis of a predetermined formula in which the net flow rate of intake air to be determined is represented by the net flow rate of intake air previously determined by the use of an intrinsic volume of a portion of said intake passage downstream of a throttle valve, compression ratio of the engine, displacement of the engine, average flow rate of intake air determined by said first means, and the cycle of engine revolutions determined by said engine revolution-cycle sensor; and electronic fuel injection control means for regulating fuel injection based upon the intake air parameter determined by said second means.

2. An engine control system as set forth in claim 1 wherein said predetermined formula is expressed as follows:

$$E(n) = K \cdot \frac{T(n-1)}{T(n)} \cdot E(n-1) + (1-K) \cdot A(n)$$

where $$K = \frac{\frac{V_S}{V_h}\left(1 - \frac{1}{\epsilon}\right)}{1 + \frac{V_S}{V_h}\left(1 - \frac{1}{\epsilon}\right)}$$

the volume of the intake passage downstream of the throttle valve is represented by $V_s$, the engine displacement $V_h$, the compression ratio $\epsilon$, the average flow rate of intake air A(n), the engine revolution cycle T(n), the net flow rate of intake air E(n) to be determined, and the net flow rate of intake air of a preceding cycle E(n-1).

3. An engine control system as set forth in claim 1 wherein said second means comprises a means for determining charging efficiency of the engine on the basis of a predetermined formula in which the charging efficiency to be determined is represented by the charging efficiency previously determined by the use of an intrinsic volume of a portion of said intake passage downstream of a throttle valve, compression ratio of the engine, displacement of the engine, standard density of ambient atmosphere, the average flow rate of intake air determined by said first means, and the cycle of engine revolutions determined by said engine revolution-cycle sensor.

4. An engine control system comprising:

an air-flow sensor detecting a flow rate of intake air sucked into an engine through an intake passage;

an engine revolution-cycle sensor detecting a cycle of engine revolutions;

a first means for determining an average flow rate of intake air by sampling the flow rate of intake air detected by said air-flow sensor at the cycle detected by said engine revolution-cycle sensor;

a second means for determining net flow rate of intake air actually sucked into the engine as an intake air parameter representative of an engine load on the basis of a predetermined formula in which the net flow rate of intake air to be determined is represented by the net flow rate of intake air previously determined by the use of an intrinsic volume of a portion of said intake passage downstream of a throttle valve, compression ratio of the engine, displacement of the engine, average flow rate of intake air determined by said first means, and the cycle of engine revolutions determined by said engine revolution-cycle sensor;

an upper-limit determining means for determining an upper limit for the average flow rate of intake air corresponding to a number of engine revolutions;

a clipping means for clipping the average flow rate of intake air at said upper limit determined by said upperlimit determining means;

an engine acceleration sensor detecting engine acceleration;

an inhibition means for inhibiting determination of said upper limit for the average flow rate of intake air until a predetermined number of ignition points or a predetermined period of time has passed from an instant when engine acceleration has been detected by said engine acceleration sensor; and electronic fuel injection control means for regulating fuel injection based upon the intake air parameter determined by said second means.

5. An engine control system as set forth in claim 4 wherein said predetermined formula is expressed as follows:

$$E(n) = K \cdot \frac{T(n-1)}{T(n)} \cdot E(n-1) + (1-K) \cdot A(n)$$

where $$K = \frac{\frac{V_S}{V_h}\left(1 - \frac{1}{\epsilon}\right)}{1 + \frac{V_S}{V_h}\left(1 - \frac{1}{\epsilon}\right)}$$

the volume of the intake passage downstream of the throttle valve is represented by $V_s$, the engine displacement $V_h$, the compression ratio $\epsilon$, the average flow of intake air A(n), the engine revolution cycle T(n), the net flow rate of intake air E(n) to be determined, and the net flow rate of intake air of a preceding cycle E(n−1).

6. An engine control system comprising:

an air-flow sensor detecting a flow rate of intake air sucked into an engine through an intake passage;

an engine revolution-cycle sensor detecting a cycle of engine revolutions;

a first means for determining an average flow rate of intake air by sampling the flow rate of intake air detected by said air-flow sensor at the cycle detected by said engine revolution-cycle sensor;

a second means for determining charging efficiency of the engine as an intake air parameter representative of an engine load on the basis of a predetermined formula in which the charging efficiency to be determined is represented by the charging efficiency previously determined by the use of an intrinsic volume of a portion of said intake passage downstream of a throttle valve, compression ratio of the engine, displacement of the engine, standard density of ambient atmosphere, the average flow rate of intake air determined by said first means, and the cycle of engine revolutions determined by said engine revolution-cycle sensor; and electronic fuel injection control means for regulating fuel injection based upon the intake air parameter determined by said second means.

7. An engine control system as set forth in claim 6 wherein said predetermined formula is expressed as follows:

$$CE(n) = K \cdot CE(n-1) + (1-K) \cdot A(n) \cdot T(n) \cdot K_A$$

where $$K = \frac{\frac{Vs}{Vh}\left(1-\frac{1}{\epsilon}\right)}{1+\frac{Vs}{Vh}\left(1-\frac{1}{\epsilon}\right)}, K_A = \frac{1}{Vh \cdot \rho_o}$$

the volume of the intake passage downstream of the throttle valve is represented by $V_s$, the engine displacement $V_h$, the compression ratio $\epsilon$, the average flow rate of intake air A(N), the standard density of the atmosphere $\rho_o$, the engine revolution cycle T(n), and the charging efficiency of a preceding cycle CE(n−1).

8. An engine control system comprising:

an air-flow sensor detecting a flow rate of intake air sucked into an engine through an intake passage;

an engine revolution-cycle sensor detecting a cycle of engine revolutions;

a first means for determining an average flow rate of intake air by sampling the flow rate of intake air detected by said air-flow sensor at the cycle detected by said engine revolution-cycle sensor;

a second means for determining charging efficiency of the engine as an intake air parameter representative of an engine load on the basis of a predetermined formula in which the charging efficiency to be determined is represented by the charging efficiency previously determined by the use of an intrinsic volume of a portion of said intake passage downstream of a throttle valve, compression ratio of the engine, displacement of the engine, the standard density of the atmosphere, the average flow rate of intake air determined by said first means, and the cycle of engine revolutions determined by said engine revolution-cycle sensor;

an upper-limit determining means for determining an upper limit for the average flow rate of intake air corresponding to a number of engine revolutions;

a clipping means for clipping the average flow rate of intake air at said upper limit determined by said upper-limit determining means;

an engine acceleration sensor detecting engine acceleration; nation of an inhibition means for inhibiting determine said upper limit for the average flow rate of intake air until a predetermined number of ignition points or a predetermined period of time has passed from a instant when engine acceleration has been detected by said engine acceleration sensor; and electronic fuel injection control means for regulating fuel injection based upon the intake air parameter determined by said second means.

9. An engine control system as set forth in claim 8 wherein said predetermined formula is expressed as follows:

$$CE(n) = K \cdot CE(n-1) + (1-K) \cdot A(n) \cdot T(n) \cdot K_A$$

where $$K = \frac{\frac{Vs}{Vh}\left(1-\frac{1}{\epsilon}\right)}{1+\frac{Vs}{Vh}\left(1-\frac{1}{\epsilon}\right)}, K_A = \frac{1}{Vh \cdot \rho_o}$$

the volume of the intake passage downstream of the throttle valve is represented by $V_s$, the engine displacement $V_h$, the compression ratio $\epsilon$, the average flow rate of intake air A(n), the standard density of the atmosphere $\rho_o$, the engine revolution cycle T(n), and the previous charging efficiency of a preceding cycle CE(n−1).

10. An engine control system comprising:

an air-flow sensor detecting a flow rate of intake air sucked into an engine through an intake passage;

an engine revolution-cycle sensor detecting a cycle of engine revolutions;

a first means for determining an average flow rate of intake air by sampling the flow rate of intake air detected by said air-flow sensor at the cycle detected by said engine revolution-cycle sensor;

a second means for determining an intake air parameter representative of an engine load, which parameter is one of (a) a net flow rate of intake air actually sucked into the engine and (b) charging efficiency of intake air, on the basis of a predetermined formula in which the parameter to be determined is represented by the parameter previously determined by the use of an intrinsic volume of a portion of said intake passage downstream of a throttle valve, compression ratio of the engine, displacement of the engine, average flow rate of intake air determined by said first means, and the cycle of engine revolutions determined by said engine revolution-cycle sensor; and electronic fuel injection means for regulating fuel injection based upon the intake air parameter determined by said second means.

* * * * *